United States Patent [19]

Applegate

[11] 4,072,308

[45] Feb. 7, 1978

[54] PORTABLE WEIGHT LIFTING TYPE FOREARM EXERCISER

[75] Inventor: Leslie T. Applegate, Cincinnati, Ohio

[73] Assignee: Surgical Appliance Industries, Inc., Cincinnati, Ohio

[21] Appl. No.: 785,766

[22] Filed: Apr. 7, 1977

[51] Int. Cl.[2] ..... A63B 21/06

[52] U.S. Cl. ..... 272/117; 272/900

[58] Field of Search ..... 272/67, 900, 98, 142, 272/147, 118, 136, DIG. 4, 135, 143; 35/19 R; 273/1.5 A

[56] References Cited

U.S. PATENT DOCUMENTS

| | | | |
|---|---|---|---|
| 2,475,656 | 7/1949 | Bidak | 272/67 |
| 2,918,282 | 12/1959 | Waterval | 272/117 |
| 3,023,001 | 2/1962 | Gourdouze | 273/1.5 A |
| 3,806,121 | 4/1974 | Crossley | 273/95 A |
| 3,982,755 | 9/1976 | Sarich | 272/117 |

*Primary Examiner*—William R. Browne

*Attorney, Agent, or Firm*—Wood, Herron & Evans

[57] ABSTRACT

A portable forearm exerciser including a U-shaped frame which can be removably secured to the upper edge of a door, a bracket adjustable vertically with respect to a depending leg of the frame, a hand-manipulated weight-elevating bar rotatably mounted in the bracket, a bag selectively fillable with varying amounts of water, and a cable guiding over the upper end of the frame proximate the top of the door which connects at its opposite ends to the weighted bag and the rotatable bar to facilitate raising and lowering the bag as the bar is rotated in opposite directions by the user to reel and unreel the cable.

4 Claims, 4 Drawing Figures

PORTABLE WEIGHT LIFTING TYPE FOREARM EXERCISER

This invention relates to exercisers, and more particularly to a forearm exerciser which is easily disassembled for compact transport and storage and which can readily be assembled and mounted for use.

Individuals participating in racquet sports, particularly tennis, often find it desirable to engage in exercises to strengthen their forearms. While forearm exercisers have been proposed before, they have for the most part been bulky and cumbersome. As a consequence, once the exerciser is set up at a particular location it is often impractical to transport it from one place to another, such as would be desirable if an individual were going on a vacation or the like. Due to this lack of portability, an individual vacationing, who has perhaps more time to exercise than he otherwise would have, does not have the exerciser available.

Another disadvantage associated with the bulky and cumbersome nature of forearm exercisers heretofore proposed is that once they were set up in a particular location they could not be readily moved. This poses a problem under certain circumstances, such as in cramped quarters, for example, a small apartment, where it is not always feasible to dedicate a certain area of a living room or bedroom to a piece of exercise apparatus. Under such circumstances, the exercising apparatus can consume valuable space or otherwise get in the way.

Accordingly, it has been an objective of this invention to provide a compact and portable forearm exerciser which can be readily assembled for use and disassembled for compact transport and storage. This objective has been accomplished in a preferred form of this invention by providing a rigid U-shaped frame adapted to seat on and be supported by the upper edge of a door to which it is removably secured thereto with a suitable fastener, such as a screw clamp or the like. The top of the frame is provided with a cable guide, preferably a pair of pulleys overlying opposite sides of the door. A cable is trained over the guide and has secured at one end a weight, preferably a bag which is fillable with water in varying quantities depending upon the amount of weight desired by the user. The other end of the cable is connected to a bar horizontally disposed rotatable which is gripped and rotated by the user to reel and unreel the cable and hence raise and lower the weight. The bar is mounted for rotation in a bracket which is slidable on a depending leg of the U-shaped frame to facilitate adjustable positioning of the rotatable rod at varying elevations depending upon the height of the user and/or the height of the door. The bracket which mounts the rotatable bar preferably can be slid entirely off the leg to facilitate convenient transport and storage of the exerciser.

These and other features, advantages and objectives of the invention will become more readily apparent from the detailed description thereof taken in connection with the drawings in which.

Figure 1:
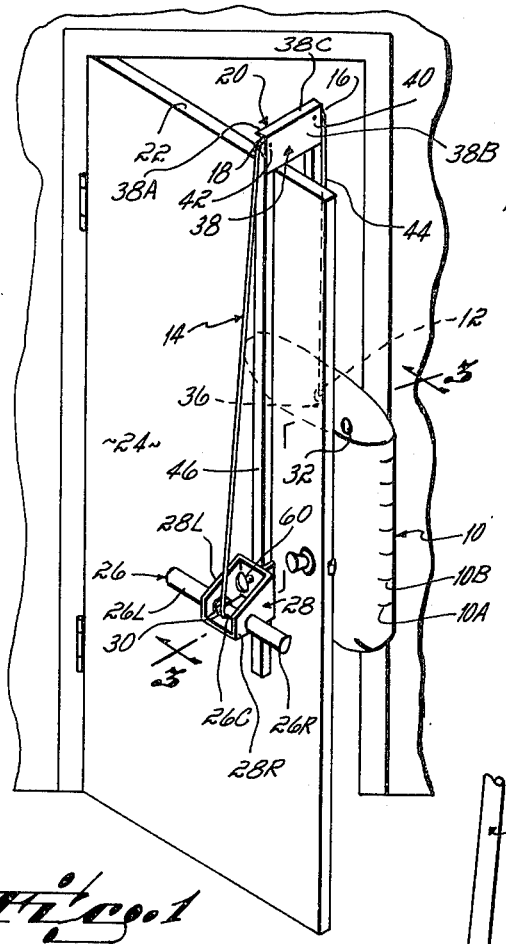
FIG. 1 is a perspective view of the forearm exerciser of this invention showing it mounted on a door for convenient use.
Figure 2:
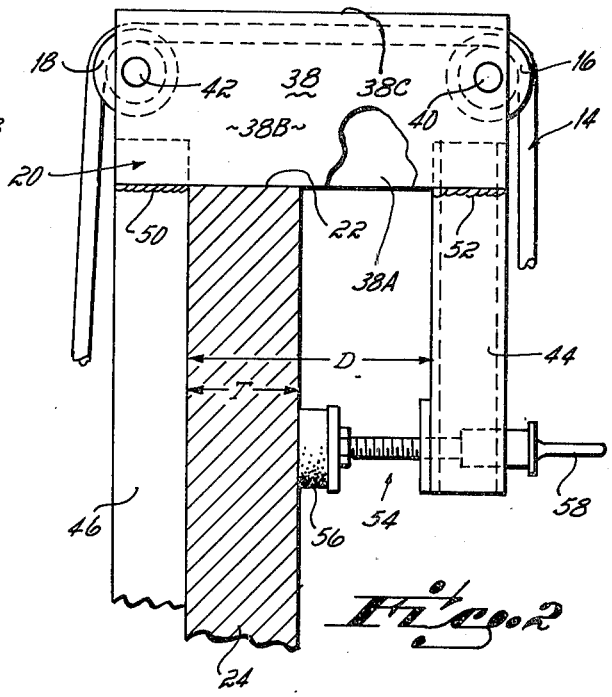
FIG. 2 is a side elevational view of the upper portion of the forearm exerciser showing the manner in which it is clamped to the upper portion of the door.
Figure 3:
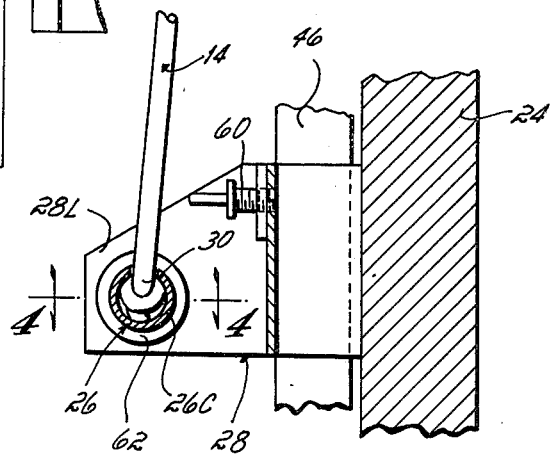
Figure 3:
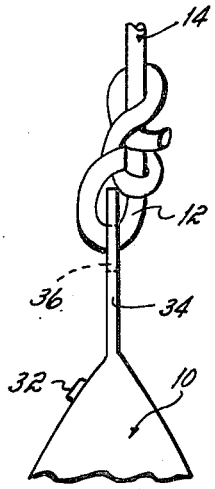
Figure 4:
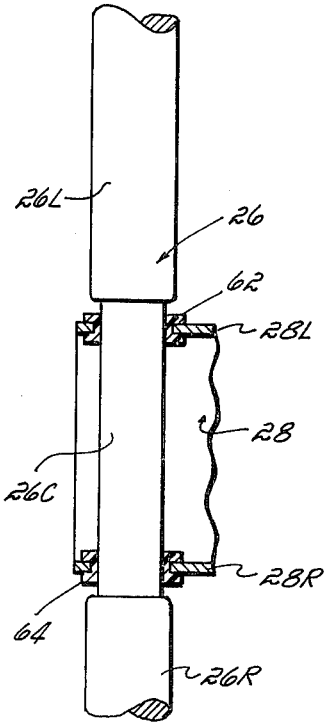

FIG. 3 is a cross-sectional view along line 3—3 of FIG. 1 through a portion of the forearm exerciser showing the manner in which the cable is connected at its opposite end to the weighted bag and the hand-manipulated weight-elevating rotatable bar; and FIG. 4 is a cross-sectional view along line 4—4 of FIG. 3 showing the hand-manipulated weight-elevating rotatable bar and its associated mounting structure.

The forearm exerciser of this invention, as shown is FIG. 1, includes a weight 10 which is suspended from one end 12 of a cable 14 which trains over a guide in the form of pulleys 16 and 18 rotatably mounted in a frame 20 which is removably secured to the upper end 22 of a door 24. The forearm exerciser also includes a hand-manipulated weight-elevating bar 26 which is mounted for rotation about a horizontal axis in a bracket 28 which is adjustably vertically positionable on the frame 20. In use, end 30 of the cable 14 is secured to the bar 26. A person exercises his forearms by gripping the opposite ends 26L and 26R of the rotatable bar 26 with his left and right hands, respectively, and rotates the bar to wind the cable 14 onto the central portion 26C of the bar 26, in turn elevating the weight 10. When the weight 10 has been elevated to a point where it is proximate the pulley 16, the user reverses the direction of rotation of the bar 26, unreeling the cable 14 from the bar section 26C, lowering the weight 10. To strengthen one's forearm, the user repeatedly alternately rotates the bar 26 in opposite directions to alternately reel and unreel the cable 14 and raise and lower the weight 10.

To facilitate portability of the forearm exerciser, the weight 10 is preferably in the form of a transparent plastic bag having a selectively closable opening 32 in the top portion thereof to permit the bag to be filled with a suitable weighting material such as water, sand or the like, to a level corresponding to the weight desired by the user. Suitable graduation 10A, 10B, . . . can be provided on the side of the bag 10 to indicate the weight of the bag when filled to levels corresponding to the various graduated marks. When it is desired to store, transport or otherwise render the forearm exerciser inoperative, the bag 10 is emptied and folded for convenient storage or transport. The upper end of the bag is provided with a suitable marginal flap 34 having an eyelet 36 for convenient attachment to the end 12 of the cable. In a preferred form of the invention the cable end 12 is passed through the eyelet 36 in the flap 34 of the bag 10 and secured by knotting it.

The frame 20 includes a horizontal channel shape cross-member 38 having spaced opposite depending sides 38A and 38B which are integrally connected to each other along their upper edges by a top plate 38C. The pulleys 16 and 18 over which the cable 14 is trained are disposed between depending walls 38A and 38B and mounted to opposite ends of the cross-member 38 by horizontally disposed pins 40 and 42 which have their opposite ends anchored in the cross-member side walls 38A and 38B. With the pulleys 16 and 18 mounted within the channel-shaped cross-member 38, the cable 12 is effectively captured.

Also forming part of the frame 20 are depending spaced apart parallel vertically disposed legs 44 and 46 which are rigidly secured at their upper ends to the channel shaped cross-member 38, for example, by weldments 50 and 52. Leg 44 is relatively short and has threadably engaged with its lower end a threaded clamping plunger 54 having a rubber tip 56 at one end and a conveniently-grippable wing 58 at the other end. When the frame 20 is placed atop a door 24 with the cross-member 38 resting on the upper edge 22 of the door, the plunger 54 is advanced by turning the wing 58 to clamp the door between the rubber plunger tip 56 and the frame leg 46, thereby securing the frame to the door.

The frame leg 46 is relatively long compared to the leg 44 and has slidably mounted on it the bracket 28 which can be secured to the leg 46 at any desired vertical elevation with a clamping thumb screw 60. The bracket 28 includes left and right side plates 28L and 28R which are vertically disposed and spaced apart from each other. The side plates 28L and 28R of the bracket 28 are provided with suitable openings for slidably receiving the rotatable bar 26. The plates 28L and 28R of the bracket 28 are rigidly secured to a sleeve 28S which slidably receives the frame leg 46.

To facilitate ease of rotation of the bar 26 in the bracket walls 28L and 28R suitable bearing 62 and 64 are provided in the bracket walls for rotationally receiving the bar 26.

The cable end 30 can be fastened in any suitable manner to the central portion 26C of the rotatable bar 26. For example, a hole can be provided in the central portion 26C of the bar 26 through which the cable end 30 is inserted and thereafter knotted to prevent withdrawal.

To enhance to portability of the forearm exerciser of this invention and its compactness when stored, the bracket 28 preferably is defined such that it can be slid off the lower end of the frame leg 46 when the thumb screw 60 is loosened. With the bracket 28 removed from the leg 46 and the bag 10 emptied, the forearm exerciser is susceptive of compact storage. By virtue of the vertical adjustability of the bracket 28 relative to the frame leg 46, the elevation of the bar 26 can be adjusted to suit the needs of user's of different height as well as for variations in the height of the door 24. Additionally, and by virtue of the adjustability of the plunger 54 and the fact that the distance D between the confronting surfaces of the legs 44 and 46 is substantially greater than the thickness T of the door 24, the frame 20 can be mounted conveniently on doors of varying thickness.

I claim:

1. A forearm exerciser comprising:

a rigid U-shaped frame means adapted to be secured over the top of a door, said means including first and second spacedapart generally parallel legs and a transverse cross-member rigidly underconnecting said legs each other at their upper ends, a clamp means mounted on the lower end of the first leg and movable against one face of a door for urging the second leg against the other face of the door when the legs straddle the door faces with the cross-member resting atop the upper edge of the door, a cable guide on said transverse cross member, a flexible cable slidably engaged with said guide, said cable having first and second ends, a weight attached to said first cable end, a rod attached to said second cable end, said rod having a hand-engageable section to facilitate gripping said rod with a user's hand, and a rotatable mount means secured to said second leg for mounting said rod for rotation about a generally horizontal axis generally perpendicular to said second leg to facilitate reeling and unreeling said cable on said rod, and in turn raising and lowering said weight, when said rod is gripped by a user's hand and rotated in first and second opposite directions, respectively.

2. The exerciser of claim 1 wherein said second leg is substantially longer than said first leg, and wherein said mount is selectively adjustably positionable along the length of said second leg to accommodate different height users and/or different height doors.

3. The exerciser of claim 2 wherein said mount includes a sleeve slidably embracing said second leg and a clamp element selectively engageable with said sleeve and second leg for clamping said sleeve, and in turn said rod mount to said second leg at different selectively adjustable vertical positions.

4. The exerciser of claim 1 wherein said cross member has an inverted channel-shaped cross-section defined by spaced-apart depending sides connected along their upper edges by a top plate, and wherein said guide is disposed between said depending sides and spaced from said top plate along their upper edges to capture said cable between said guide and said top plate.

* * * * *